US007070912B2

(12) United States Patent
Park et al.

(10) Patent No.: US 7,070,912 B2
(45) Date of Patent: Jul. 4, 2006

(54) METHOD OF MANUFACTURING MONOLITHIC INKJET PRINTHEAD

(75) Inventors: Byung-ha Park, Suwon-si (KR); Myong-jong Kwon, Suwon-si (KR); Young-ung Ha, Suwon-si (KR); Sung-joon Park, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 11/028,665

(22) Filed: Jan. 5, 2005

(65) Prior Publication Data

US 2005/0155949 A1 Jul. 21, 2005

(30) Foreign Application Priority Data

Jan. 20, 2004 (KR) ..... 10-2004-0004429

(51) Int. Cl.
*B41J 2/16* (2006.01)

(52) U.S. Cl. ..... 430/320; 216/27

(58) Field of Classification Search ..... None
See application file for complete search history.

(56) References Cited

U.S. PATENT DOCUMENTS 6,235,212 B1 * 5/2001 Silverbrook ..... 216/27
6,475,402 B1 11/2002 Nordstrom et al. ..... 216/27
6,482,574 B1 * 11/2002 Ramaswami et al. ..... 430/320

FOREIGN PATENT DOCUMENTS

| | | |
|---|---|---|
| JP | 11-192714 | 7/1999 |
| JP | 2002-254662 | 9/2002 |
| KR | 2002-0043826 | 6/2002 |
| KR | 2003-0012061 | 2/2003 |
| KR | 2003-0037772 | 5/2003 |
| KR | 2003-0079199 | 10/2003 |

* cited by examiner

*Primary Examiner*—John A. McPherson
(74) *Attorney, Agent, or Firm*—Roylance, Abrams, Berdo & Goodman, L.L.P.

(57) ABSTRACT

A method of manufacturing a monolithic inkjet printhead wherein the uniformity of the ink flow path is maintained by ensuring that the flow path forming layer and the nozzle layer are completely adhered to each other. The method includes forming a heater and electrode on a substrate, coating a negative photoresist on the substrate, and patterning the photoresist using a photolithography process to form an flow path forming layer that defines an ink flow path. The method further comprises steps for then forming a sacrificial layer so as to cover the flow path forming layer and then flattening upper surfaces of the flow path forming layer and the sacrificial layer using a chemical mechanical polishing (CMP) process such that when a nozzle layer is then formed, the flow path forming layer and the nozzle layer are completely adhered to each other.

14 Claims, 10 Drawing Sheets

METHOD OF MANUFACTURING MONOLITHIC INKJET PRINTHEAD

CROSS-REFERENCE TO RELATED APPLICATIONS

This application claims the benefit under 35 U.S.C. §119 (a) of Korean Patent Application No. 2004-4429, filed in the Korean Intellectual Property Office on Jan. 20, 2004, the entire contents of which are incorporated herein by reference.

BACKGROUND OF THE INVENTION

1. Field of the Invention

The present invention relates to a method of manufacturing a monolithic inkjet printhead. More particularly, the present invention relates to a method of manufacturing a monolithic inkjet printhead, which can easily obtain a uniform ink flow path by controlling a shape and a size of the ink flow path.

2. Description of the Related Art

In general, an inkjet printhead is a device that ejects fine droplets of an ink onto desired positions of a recording medium to print data in predetermined colors. The inkjet printhead can be classified into two types according to an ejecting mechanism of the ink droplet. One of the types is a thermal driving inkjet printhead that generates bubbles in the ink using a thermal source and which ejects the ink droplet by the expanding force of the bubbles created, and the other is a piezoelectric driving inkjet printhead that ejects the ink droplet by applying pressure onto the ink due to a transformed piezoelectric material.

FIG. 1 shows a general structure of a thermal driving type inkjet printhead. Referring to FIG. 1, the inkjet printhead includes a substrate 10, a flow path forming layer 20 stacked on the substrate 10, and a nozzle layer 30 that is formed on the flow path forming layer 20. An ink feed hole 51 is formed on the substrate 10, and an ink chamber 53 in which the ink is filled, and a restrictor 52 that connects the ink feed hole 51 and the ink chamber 53, are both formed on the flow path forming layer 20. A nozzle 54, through which the ink is ejected from the ink chamber 53, is formed on the nozzle layer 30. In addition, a heater 41 that heats the ink in the ink chamber 53 and an electrode 42 that supplies the electric current to the heater 41, are also both disposed on the substrate 10.

The ink droplet ejecting mechanism in the thermal driving type inkjet printhead having the above structure will now be described in greater detail as follows. The ink is supplied from an ink storage (not shown) to the ink chamber 53 after passing through the ink feed hole 51 and the restrictor 52. The ink filled in the ink chamber 53 is heated by the heater 41 that is made of a resistance heating material in the ink chamber 53. Accordingly, the ink is boiled and a bubble is generated, and the generated bubble expands to compress the ink filled in the ink chamber 53. Thus, the ink in the ink chamber 53 is ejected from the ink chamber 53 through the nozzle 54.

The thermal driving type inkjet printhead having the above structure can be integrally manufactured using a photolithography process, and the manufacturing process is shown in FIGS. 2A through 2E. Referring to FIG. 2A, the substrate 10 of a predetermined thickness is prepared, and the heater 41 for heating the ink and the electrode 42 for supplying the electric current to the heater 41, are both formed on the substrate 10.

In addition, as shown in FIG. 2B, a negative photoresist is coated on the entire surface of the substrate 10 to a predetermined thickness, and the coated photoresist is then patterned using a photolithography process so as to surround the ink chamber 53 and the restrictor 52, such that the flow path forming layer 20 is then formed.

In addition, as shown in FIG. 2C, a sacrificial layer 60 is formed by filling in a space that is surrounded by the flow path forming layer 20 with a positive photoresist. Specifically, the positive photoresist is coated on the entire surface of the substrate 10 to a predetermined thickness, and then the coated photoresist is patterned using a photolithography process to form the sacrificial layer 60. Here, since the positive photoresist is coated generally using a spin coating method, an upper surface of the photoresist is not planar due to the centrifugal force used. That is, as represented by a chain line in FIG. 2C, the positive photoresist rises convexly near the sides of the flow path forming layer 20. When the positive photoresist, the upper surface of which is not a planar surface, is then patterned, an edge portion of the sacrificial layer 60 rises sharply upward.

As shown in FIG. 2D, the negative photoresist is coated on the flow path forming layer 20 and the sacrificial layer 60 to a predetermined thickness, and the photoresist is patterned using a photolithography process to form the nozzle layer 30 having the nozzle 54.

Next, as shown in FIG. 2E, the ink feed hole 51 is formed by wet etching a back surface of the substrate 10, and the sacrificial layer 60 is removed through the ink feed hole 51. The restrictor 52 and the ink chamber 53 are then formed on the flow path layer 20.

However, when the nozzle layer 30 is formed on the sacrificial layer 60 by coating the negative photoresist in the step shown in FIG. 2D, the protruded edge portion of the sacrificial layer 60 formed by the positive photoresist may react with a solvent in the negative photoresist so that the edge portion may be transformed or melted. If the transformation or melting of the sacrificial layer 60 is generated, a cavity 70 is formed between the flow path forming layer 20 and the nozzle layer 30 as shown in FIG. 2E.

FIG. 3 is a SEM picture showing a cross section of the conventional inkjet printhead. As shown in FIG. 3, the cavity is generated between the flow path forming layer 20 and the nozzle layer 30, thus the flow path forming layer 20 and the nozzle layer 30 cannot be completely adhered to each other.

As described above, according to the conventional method of manufacturing the inkjet printhead, the shape and the size of the ink flow path cannot be controlled and therefore, uniformity of the ink flow path cannot be ensured. Accordingly, the ink ejecting performance of the printhead is lowered. Also, since the flow path forming layer 20 and the nozzle layer 30 are not completely adhered to each other, the durability of the inkjet printhead is degraded.

In addition, in the step shown in FIG. 2D, the negative photoresist coated on the sacrificial layer 60 is patterned through an exposure process, a developing process, and a baking process. However, the exposure process affects the positive photoresist forming the sacrificial layer 60 under the negative photoresist, as well as the negative photoresist forming the nozzle layer 30. In addition, if the positive photoresist is irradiated by ultraviolet ray, a photosensitive material included in the photoresist is photolyzed and $N_2$ gas is generated. The $N_2$ gas expands in the baking process and pushes the nozzle layer 30, thus the nozzle layer 30 may be spatially transformed.

Accordingly, a need exists for a method for manufacturing a monolithic inkjet printhead which can obtain a uniform ink flow path by controlling a shape and a size of the ink flow path with greater precision.

SUMMARY OF THE INVENTION

Accordingly, the present invention has been provided to solve the above and other problems. The present invention provides a method of manufacturing a monolithic inkjet printhead, wherein the method flattens an upper surface of a sacrificial layer to easily control a shape and a size of an ink flow path so that an even ink flow path can be obtained.

According to an aspect of the present invention, a method is provided for manufacturing a monolithic inkjet printhead including the steps of (a) forming a heater for heating ink and an electrode for supplying electric current to the heater on a substrate, (b) coating a negative photoresist on the substrate on which the heater and the electrode are formed, and patterning the photoresist using a photolithography process to form an flow path forming layer that defines an ink flow path, (c) forming a sacrificial layer so as to cover the flow path forming layer on the substrate on which the flow path forming layer is formed, (d) flattening the upper surfaces of the flow path forming layer and the sacrificial layer using a chemical mechanical polishing (CMP) process, (e) coating a negative photoresist on the flow path forming layer and the sacrificial layer, and patterning the photoresist using a photolithography process to form a nozzle layer having a nozzle, (f) forming an ink feed hole on the substrate, and (g) removing the sacrificial layer. The substrate may be a silicon wafer.

Step (b) may further include forming a first photoresist by coating the negative photoresist on the entire surface of the substrate, exposing the first photoresist using a first photo mask having an ink flow path pattern thereon, and forming the flow path forming layer by developing the first photoresist to remove unexposed portion.

The sacrificial layer may be formed of a positive photoresist or a non-photosensitive polymer precursor resin, and the positive photoresist may be an imide-based positive photoresist. The polymer precursor resin may be at least one selected from a group consisting of a phenol resin, a polyurethane resin, an epoxy resin, a poly-imide resin, an acryl resin, a poly-amid resin, a urea resin, a melamine resin, and a silicon resin.

In step (c), the sacrificial layer may be formed to be higher than the flow path forming layer. The sacrificial layer may also be formed using a spin coating method.

Step (d) may flatten the upper surfaces of the flow path forming layer and the sacrificial layer by polishing the upper portions of the flow path forming layer and the sacrificial layer using the chemical mechanical polishing process until the height of the layer reaches the desired ink flow path height.

Step (e) may include the operations of forming a second photoresist by coating a negative photoresist on the flow path forming layer and the sacrificial layer, exposing the second photoresist using a second photo mask having a nozzle pattern thereon, and forming a nozzle and a nozzle layer by developing the second photoresist to remove unexposed portion.

Step (f) may include the operations of coating a photoresist on a back surface of the substrate, forming an etching mask for forming the ink feed hole by patterning the photoresist, and etching the back surface of the substrate, which is exposed through the etching mask, to form the ink feed hole.

BRIEF DESCRIPTION OF THE DRAWINGS

The above and other features and advantages of the present invention will become more apparent by describing in detail exemplary embodiments thereof with reference to the attached drawings in which.

Throughout the drawings, like reference numerals will be understood to refer to like parts, components and structures.

DETAILED DESCRIPTION OF THE EXEMPLARY EMBODIMENTS

Figure 1:
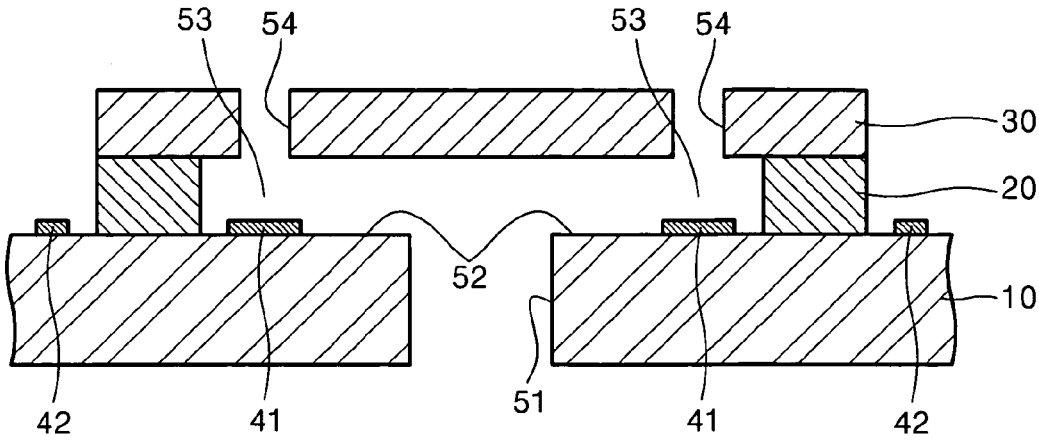
FIG. 1 (PRIOR ART)
FIG. 1 is a cross sectional view showing a general structure of a thermal driving inkjet printhead.
Figure 2A:
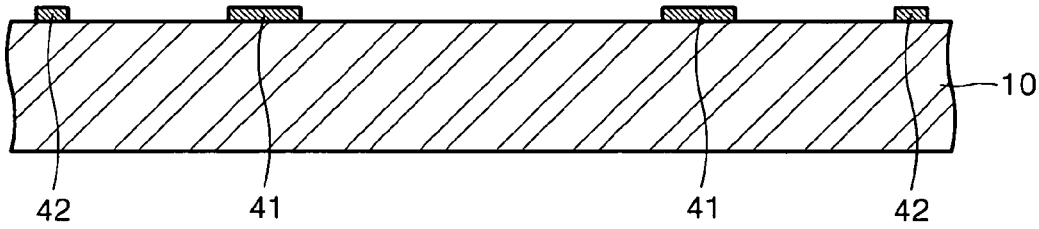
FIG. 2A (PRIOR ART)
FIGS. 2A through 2E are cross sectional views illustrating a conventional method of manufacturing an inkjet printhead and problems thereof.
Figure 2B:
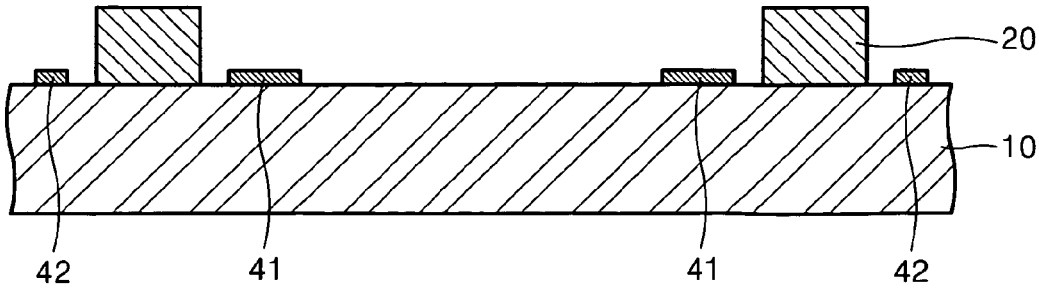
FIG. 2B (PRIOR ART)
Figure 2C:
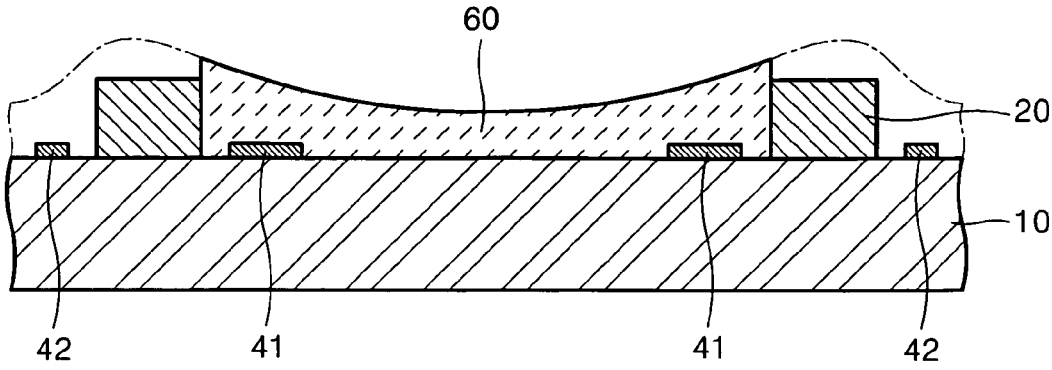
FIG. 2C (PRIOR ART)
Figure 2D:
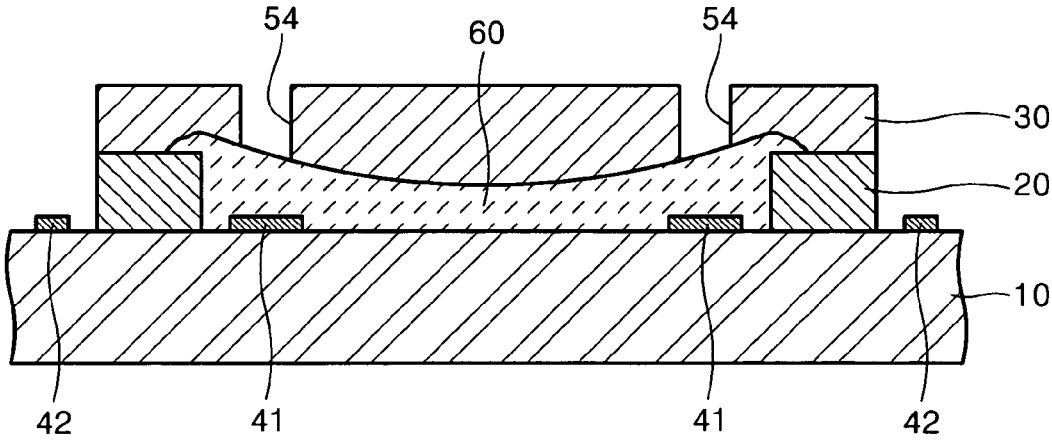
FIG. 2D (PRIOR ART)
Figure 2E:
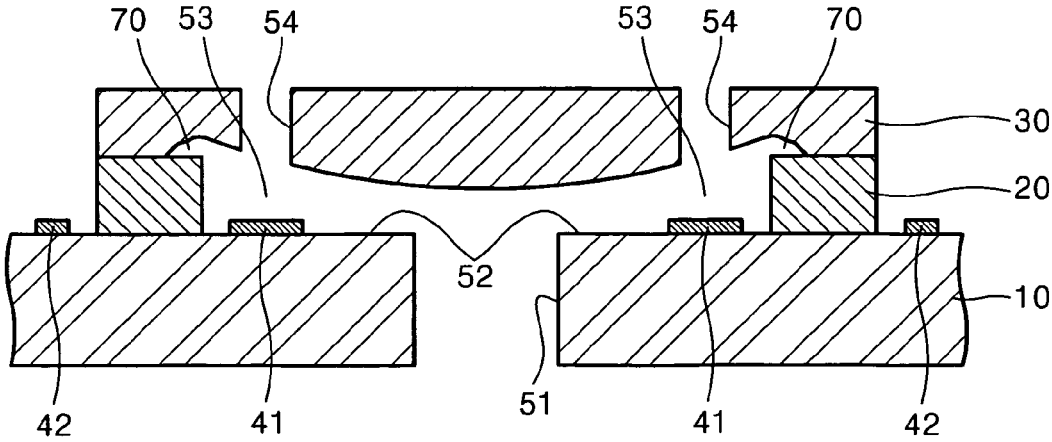
FIG. 2E (PRIOR ART)
Figure 3:
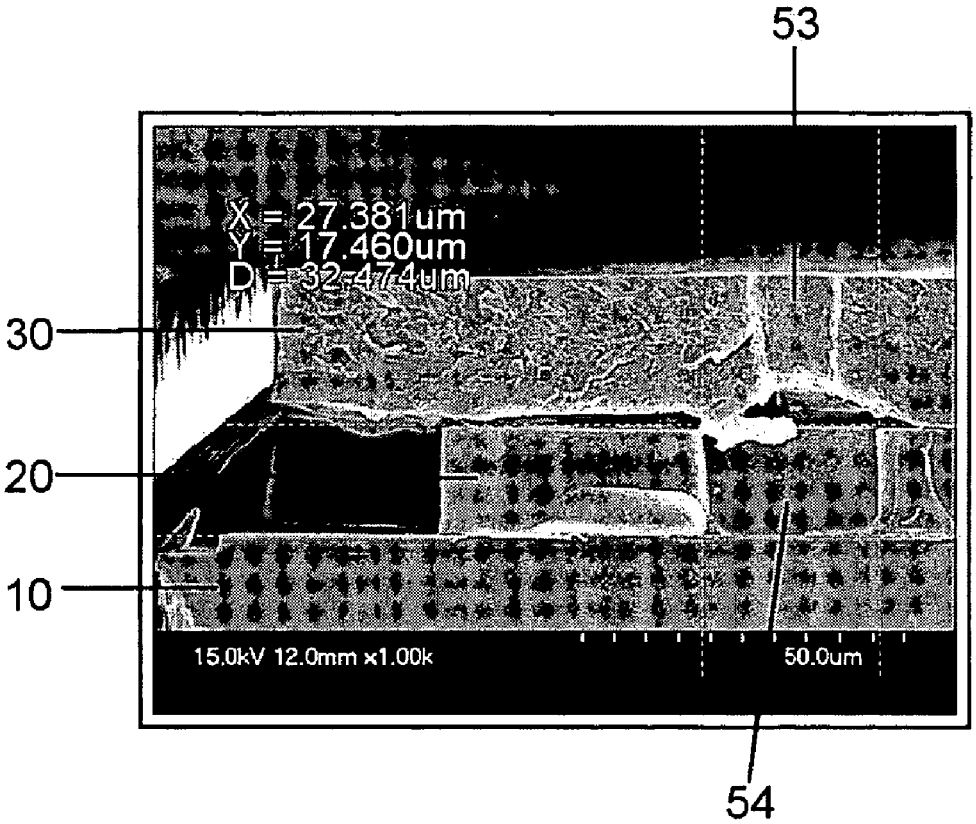
FIG. 3 (PRIOR ART)
FIG. 3 is a SEM picture showing a cross section of a conventional inkjet printhead.

The present invention will now be described more fully with reference to the accompanying drawings, in which exemplary embodiments of the invention are shown. The invention may, however, be embodied in many different forms and should not be construed as being limited to the embodiments set forth herein; rather, these embodiments are provided so that this disclosure will be thorough and complete, and will fully convey the concept of the invention to those skilled in the art. In the drawings, the thicknesses of layers and regions are exaggerated for clarity. Like reference numerals in the drawings denote like elements, and thus their descriptions are not repeated. Also, when a layer is disposed on a substrate or on another layer, the layer may be disposed directly on the substrate or the other layer, or a layer may be disposed therebetween.

In addition, a mere part of a silicon wafer is shown in the drawings, and tens to hundreds of inkjet printheads according to the present invention can be formed from a wafer.

Figure 4A:
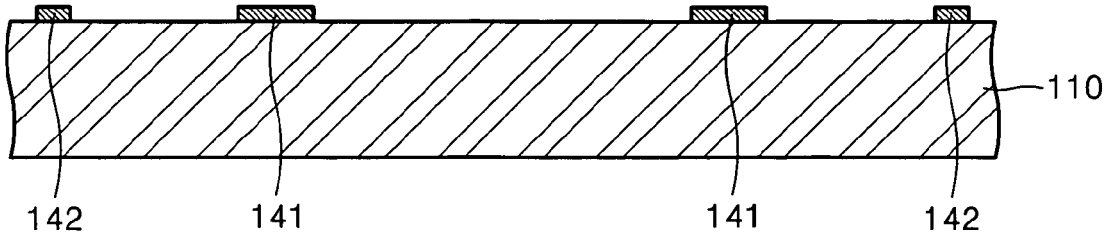
FIGS. 4A through 4L are views illustrating a method of manufacturing an inkjet printhead according to an embodiment of the present invention.

FIGS. 4A through 4L are views illustrating a method of manufacturing a monolithic inkjet printhead according to an embodiment of the present invention. As shown in FIG. 4A, a heater 141 for heating ink and an electrode 142 for supplying electric current to the heater 141 are formed on a substrate 110. Here, a silicon wafer is used as the substrate 110. The silicon wafer is widely used to manufacture semiconductor devices, and provides numerous advantageous in the mass-production of such devices.

In addition, the heater 141 can be formed by depositing a resistance heating material, such as a tantalum-nitride alloy or a tantalum-aluminum alloy, using a sputtering or a chemical vapor deposition method, and then patterning the deposited resistance heating material. The electrode 142 can be formed by depositing a metal having a high conductivity, such as an aluminum or an aluminum alloy, on the substrate 110 using the sputtering method, and then patterning the metal. Alternatively, a protecting layer made of a silicon oxide or a silicon nitride may be formed on the heater 141 and the electrode 142.

Figure 4B:
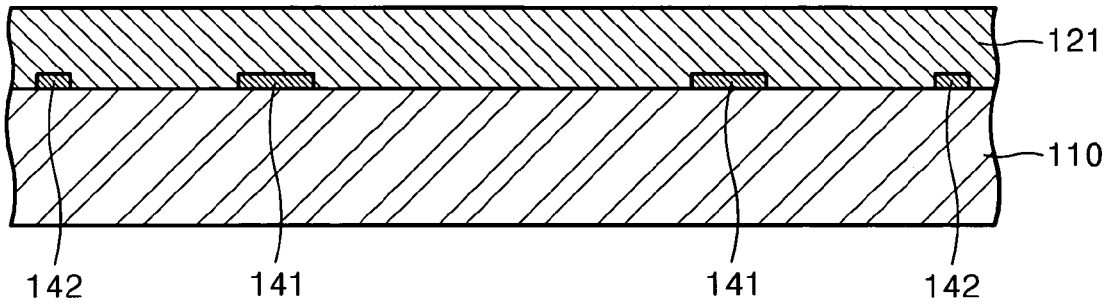

Next, as shown in FIG. 4B, a first photoresist 121 is formed on the substrate 110, on which the heater 141 and the electrode 142 are formed. The first photoresist 121 becomes a flow path forming layer (120 in FIG. 4D) that defines an ink flow path, including an ink chamber and a restrictor, using a process which will be described in greater detail below, and thus, it is desirable that the first photoresist 121 is formed of a negative photoresist that is chemically stable for contact with the ink. Specifically, the first photoresist 121 is formed by coating the negative photoresist on the entire surface of the substrate 110 to a predetermined thickness. Here, the negative photoresist can be coated on the substrate using a spin coating method.

Figure 4C:
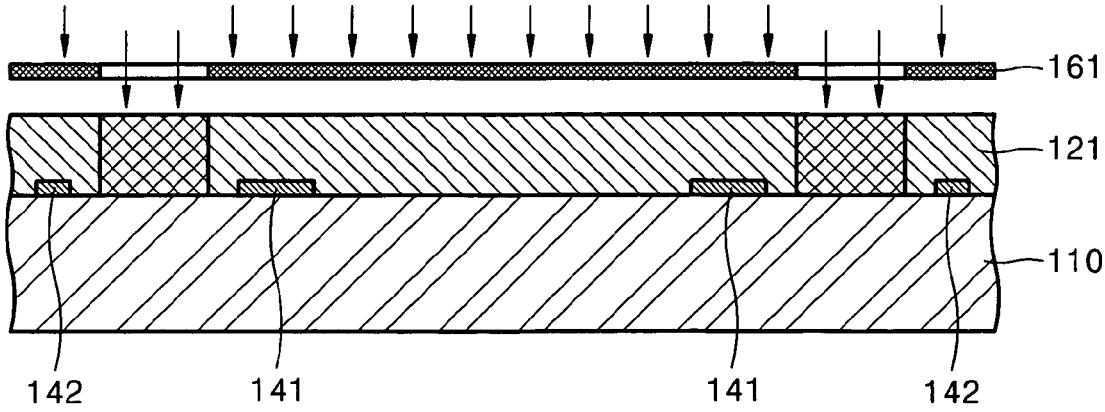

As shown in FIG. 4C, the first photoresist 121 formed of the negative photoresist is exposed to ultraviolet rays via a first photo mask 161, on which the patterns of the ink chamber and the restrictor are formed. In the above exposure process, the portion of the first photoresist 121 which is exposed to the ultraviolet ray is hardened and therefore develops a high chemical resistance and mechanical strength. However, the remaining portion that is not exposed is melted easily by a developer.

Figure 4D:
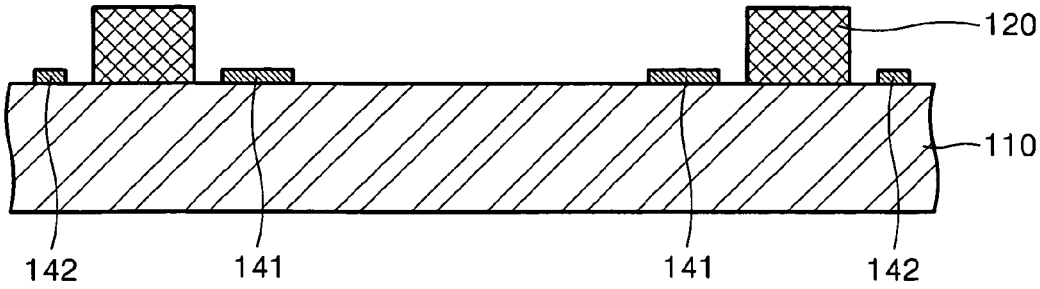

When the portion that was not exposed is removed by developing the first photoresist 121, the flow path forming layer 120 that defines the ink flow path is formed as shown in FIG. 4D.

Figure 4E:
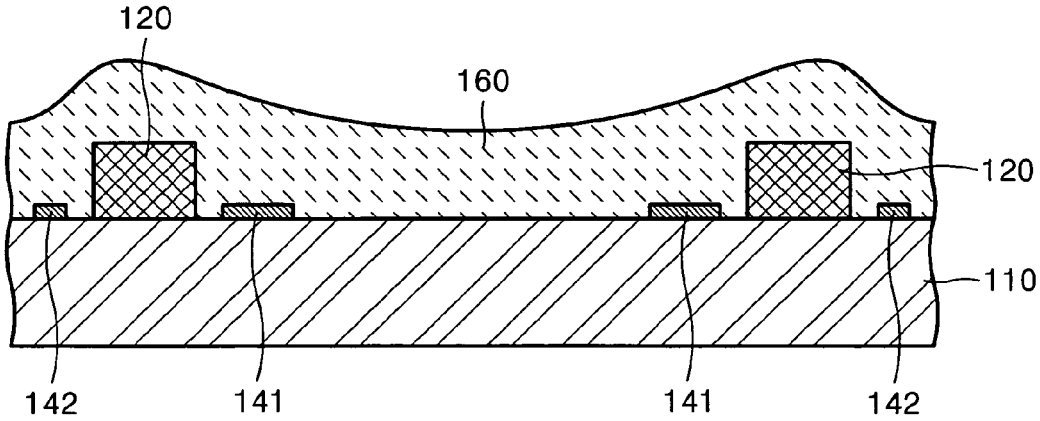

Next, as shown in FIG. 4E, a sacrificial layer 160 is formed on the substrate 110 so as to cover the flow path forming layer 120. Here, the sacrificial layer 160 is formed at a higher position than the flow path forming layer 120. The sacrificial layer 160 can be formed by coating the positive photoresist on the substrate 110 using a spin coating method. Here, it is desirable that the positive photoresist is an imide-based positive photoresist. If the imide-based positive photoresist is used as the sacrificial layer 160, the positive photoresist is not affected by the solvent included in the negative photoresist, and does not generate $N_2$ gas when it is exposed to the solvent. Therefore, a process of hard baking the imide-based positive photoresist at a temperature of about 140° C. is required. However, the sacrificial layer 160 may also be formed by coating a liquid non-sensitive polymer precursor resin on the substrate 110 to a predetermined thickness, and then hard baking the resin. Here, it is desirable that the polymer precursor resin is at least one selected from a group consisting of a phenol resin, a polyurethane resin, an epoxy resin, a poly-imide resin, an acryl resin, a poly-amid resin, a urea resin, a melamine resin, and a silicon resin.

Figure 4F:
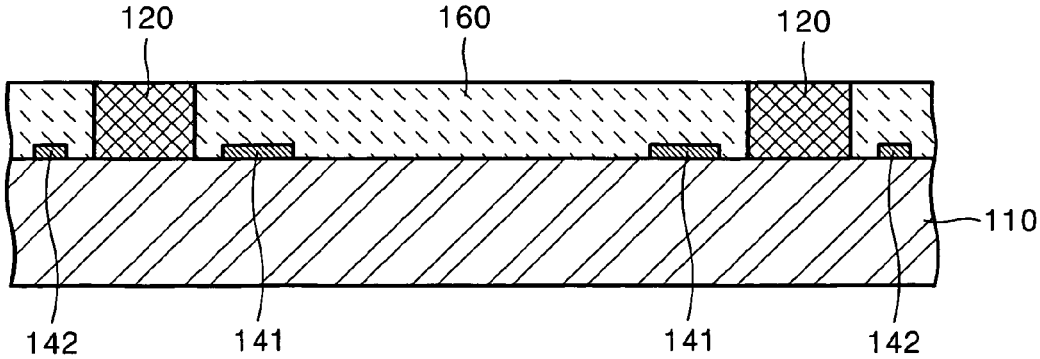

As shown in FIG. 4F, upper surfaces of the flow path forming layer 120 and the sacrificial layer 160 are then flattened by a chemical mechanical polishing (CMP) process. Specifically, the upper portions of the sacrificial layer 160 and the flow path forming layer 120 are polished by the CMP process until they reach a desired height for the ink flow path, such that the upper surfaces of the flow path forming layer 120 and the sacrificial layer 160 are formed at substantially the same heights.

Figure 5A:
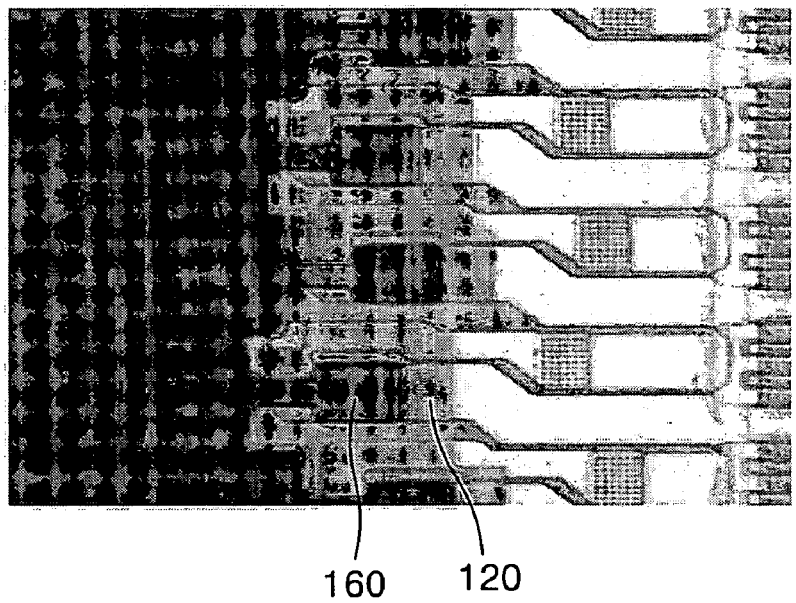
FIGS. 5A and 5B are views showing a sacrificial layer and a flow path forming layer, the upper surfaces of which are flattened by a chemical mechanical polishing process.
Figure 5B:
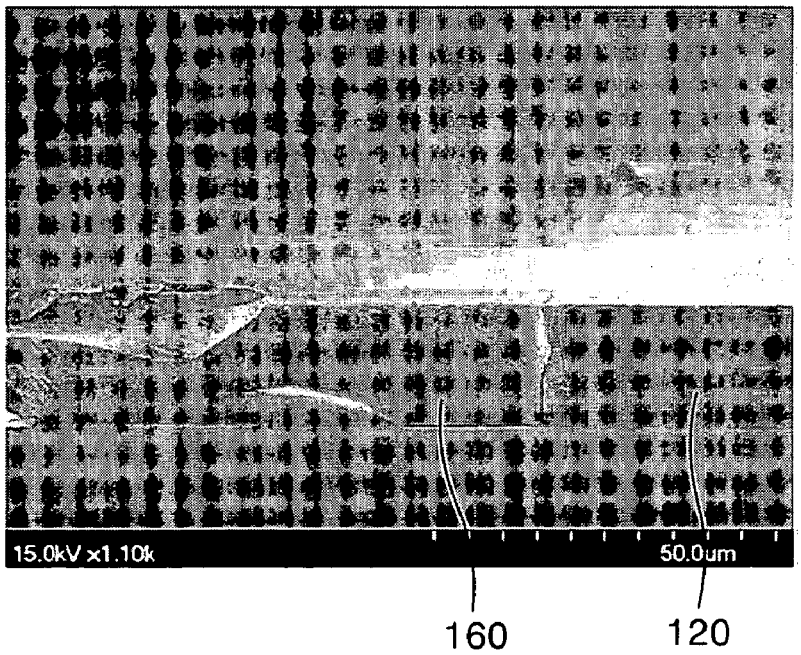

FIGS. 5A and 5B are pictures of the flow path forming layer 120 and the sacrificial layer 160 after performing the CMP process. As shown therein, the upper surfaces of the flow path forming layer 120 and the sacrificial layer 160 are flattened by the CMP process.

Figure 4G:
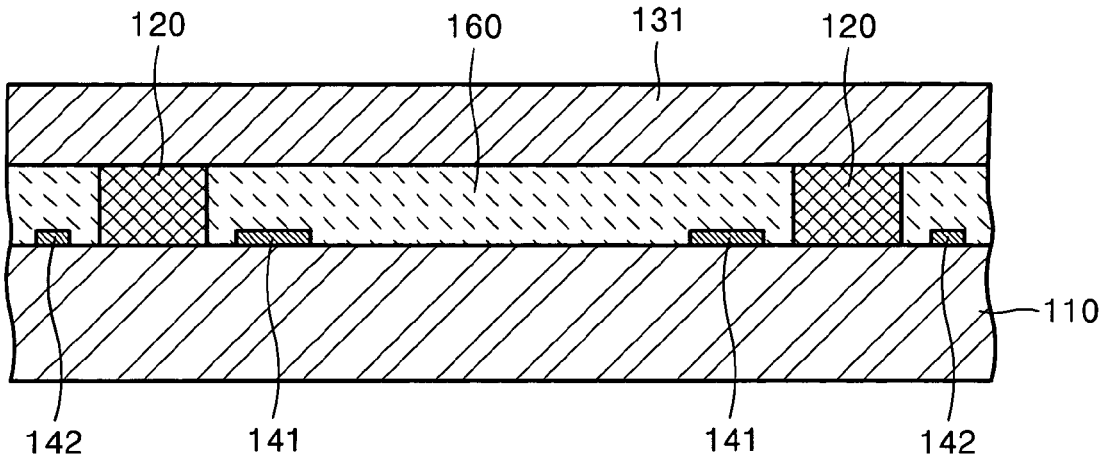

Next, as shown in FIG. 4G, a second photoresist 131 is formed on the flattened flow path forming layer 120 and the sacrificial layer 160. The second photoresist 131 becomes a nozzle layer (130 in FIG. 41) at a step which will be described in greater detail below, thus a negative photoresist that is chemically stable is also used as the second photoresist, as with the flow path forming layer 120. Specifically, the second photoresist 131 is formed by coating the negative photoresist on the upper surfaces of the flow path forming layer 120 and the sacrificial layer 160 to a predetermined thickness. Here, the negative photoresist is coated to have a thickness such that a sufficient nozzle lengths can be ensured and pressure variations in the ink chamber can be endured.

In addition, since the sacrificial layer 160 and the flow path forming layer 120 are flattened so that the upper surfaces thereof can be formed at substantially equal heights, the transformation or melting of the edge portion of the sacrificial layer 160 due to the reaction between the negative photoresist forming the second photoresist 131, and the positive photoresist forming the sacrificial layer 160, is not generated. Accordingly, the second photoresist 131 can be closely and completely adhered to the upper surface of the flow path forming layer 120.

Figure 4H:
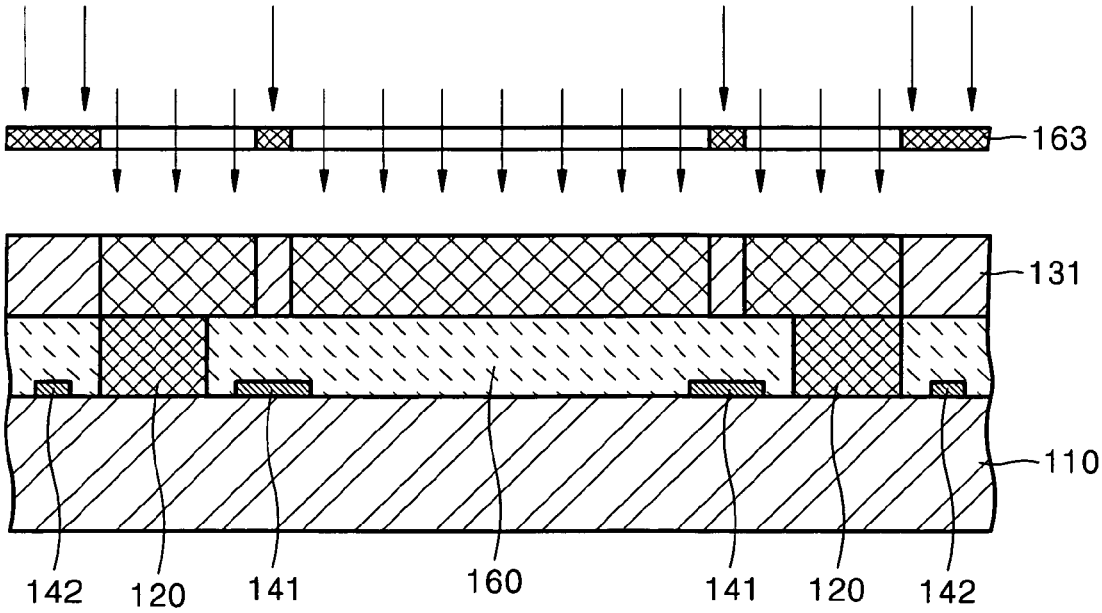
Figure 4I:
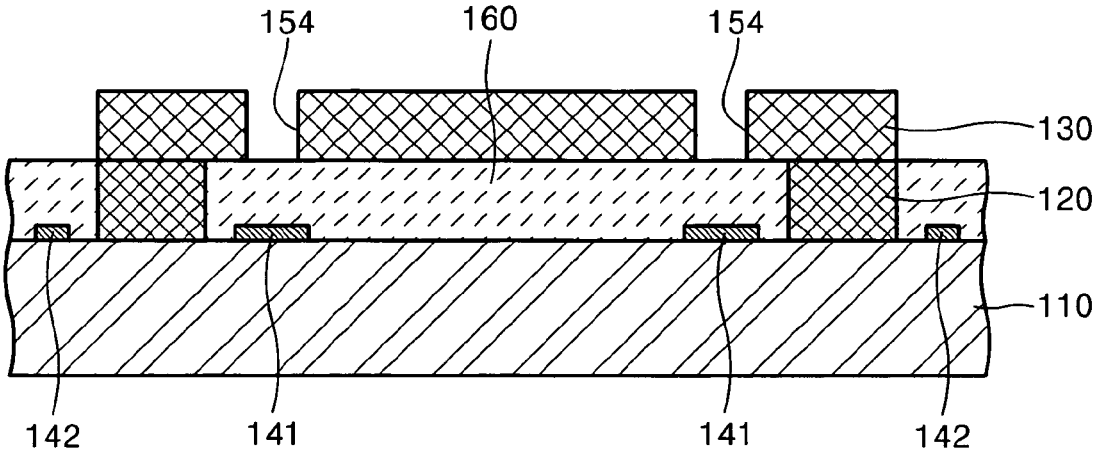

As shown in FIG. 4H, the second photoresist 131 formed of the negative photoresist is exposed via a second photo mask 163, on which a nozzle pattern is formed. In addition, when a portion that is not exposed is removed by developing the second photoresist 131, a nozzle 154 is formed as shown in FIG. 41, and the portion hardened by the exposure remains and forms the nozzle layer 130. Here, if the sacrificial layer 160 is formed of the imide-based positive photoresist as described above, even though the sacrificial layer 160 is exposed through the second photoresist 131, the undesired $N_2$ gas is not generated. Thus, the spatial transformation of the nozzle layer 130 due to the $N_2$ gas can be prevented.

Figure 4J:
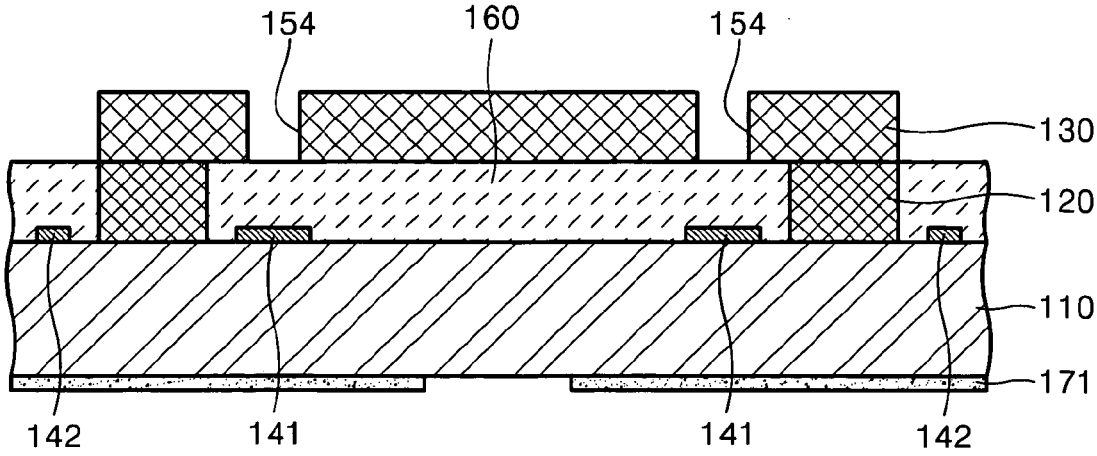
Figure 4K:
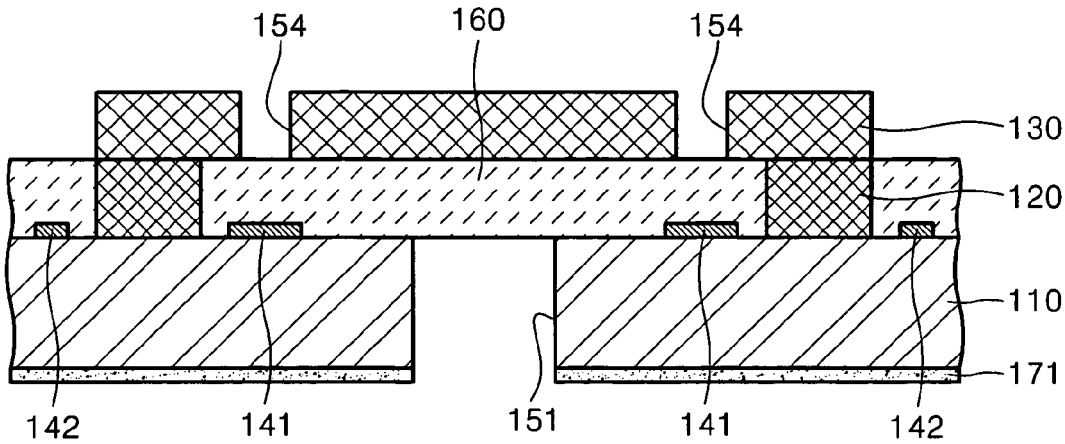

Next, as shown in FIG. 4J, an etching mask 171 is formed on a back surface of the substrate 110 for forming an ink feed hole (151 in FIG. 4K). The etching mask 171 can be formed by coating a positive photoresist or negative photoresist on the back surface of the substrate 110, and then patterning the photoresist.

Referring to FIG. 4K, the ink feed hole 151 is formed by etching the substrate 110 from the back surface of the substrate 110, which is exposed via the etching mask 171 so as to penetrate the substrate 110. The etching mask 171 is then removed. The etching operation of the substrate 110 can be performed using a dry etching method using plasma, or can be performed using a liquid etching method using a tetramethyl ammonium hydroxide (TMAH) or KOH as an etchant.

Figure 4L:
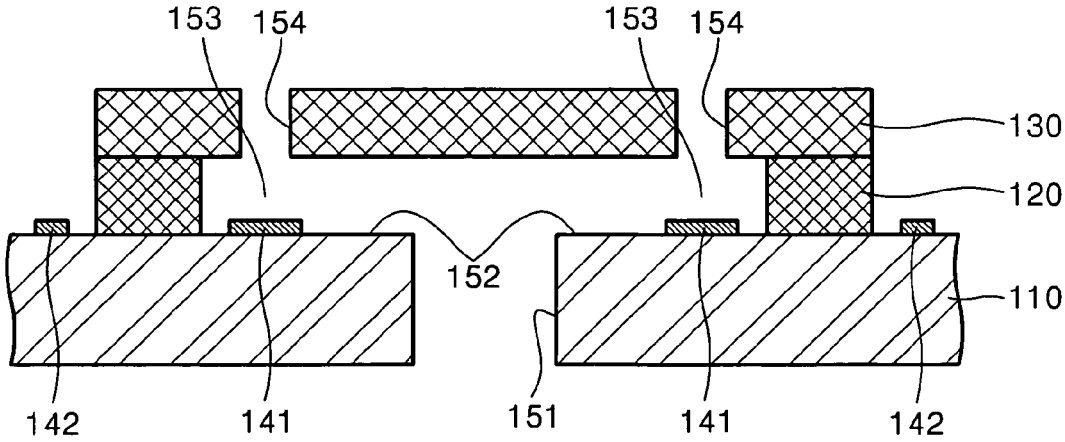

The sacrificial layer 160 is then removed using the solvent, and the ink chamber 153 and the restrictor 152 surrounded by the flow path forming layer 120 are formed as shown in FIG. 4L. The heater 141 and the electrode 142 for supplying the electric current to the heater 141 are also exposed. Accordingly, the monolithic inkjet printhead having the above structure shown in FIG. 4L is formed.

Figure 6A:
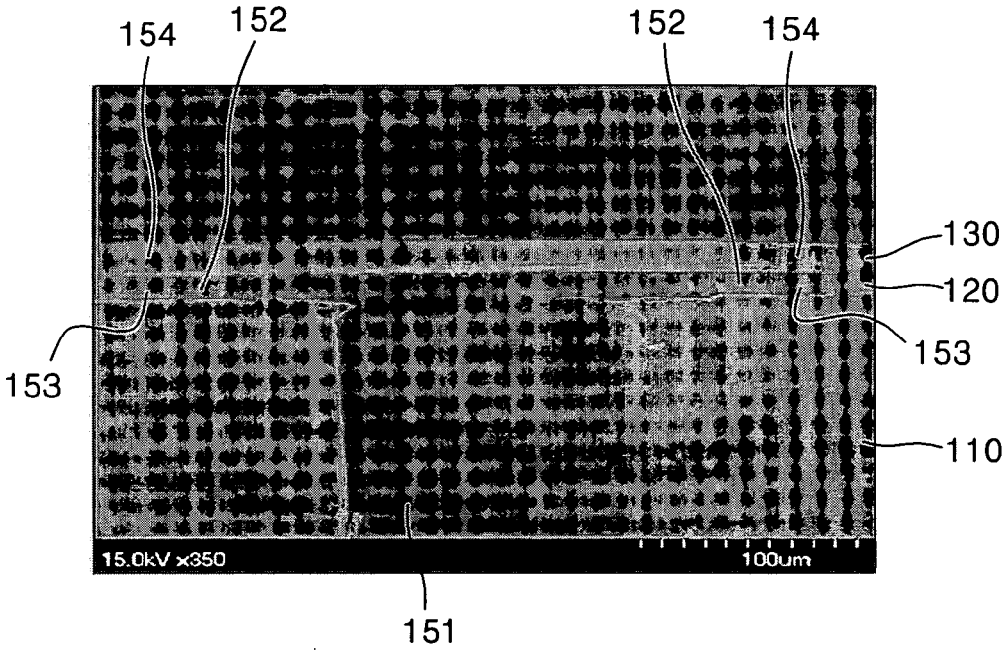
FIGS. 6A and 6B are cross sectional views showing a vertical structure of an inkjet printhead manufactured using a method according to an embodiment of the present invention.
Figure 6B:
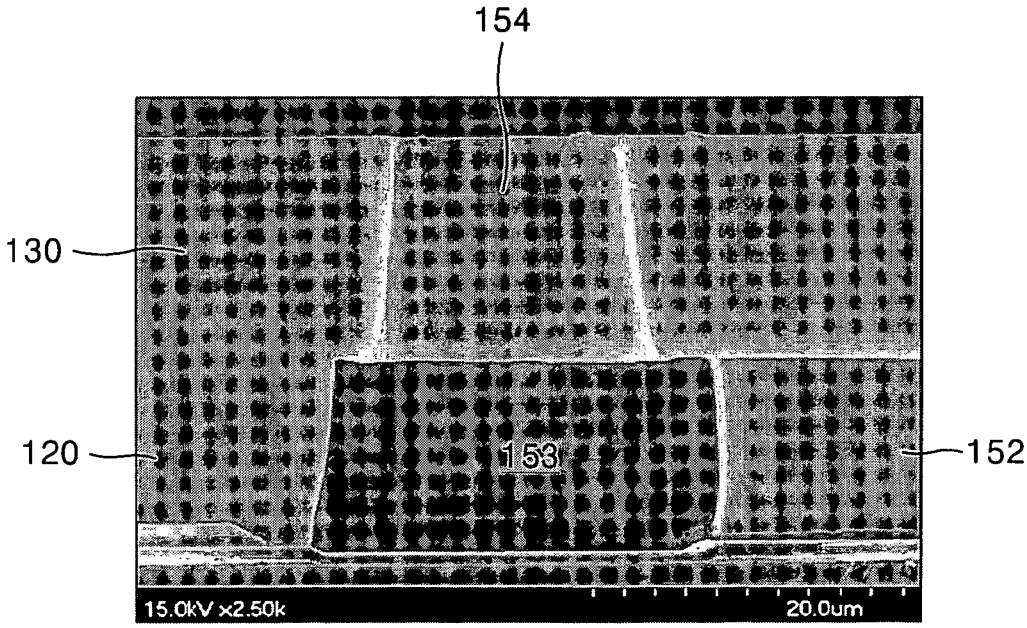

FIGS. 6A and 6B are pictures showing vertical cross sections of the inkjet printhead manufactured by the above exemplary method. Referring to FIGS. 6A and 6B, the ink chamber 153 and the restrictor 152 are formed to have substantially equal heights, and a cavity is not generated between the flow path forming layer 120 and the nozzle layer 130. Also, the nozzle layer 130 is completely adhered to the upper surface of the flow path forming layer 120.

As described above, the method of manufacturing the monolithic inkjet printhead in accordance with embodiments of the present invention has the following beneficial effects. First, since the upper surfaces of the flow path forming layer and the sacrificial layer are flattened by the CMP process, the manufacturing processes are simplified and high reproducibility can be obtained. Second, the shape and the size of the ink flow path can be easily controlled and a uniform ink flow path can be formed, thereby improving the ink ejecting performance of the inkjet printhead. Third, since the flow path forming layer and the nozzle layer can be completely adhered to each other, the durability of the printhead can be improved.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A method of manufacturing a monolithic inkjet printhead comprising the steps of:

(a) forming a heater for heating ink and an electrode for supplying electric current to the heater on a substrate;

(b) coating a negative photoresist on the substrate on which the heater and the electrode are formed, and patterning the photoresist using a photolithography process to form a flow path forming layer that defines an ink flow path;

(c) forming a sacrificial layer so as to cover the flow path forming layer on the substrate on which the flow path is formed;

(d) flattening and height adjusting upper surfaces of the flow path forming layer and the sacrificial layer by a polishing process;

(e) coating a negative photoresist on the flow path forming layer and the sacrificial layer, and patterning the photoresist using a photolithography process to form a nozzle layer having a nozzle;

(f) forming an ink feed hole on the substrate; and (g) removing the sacrificial layer.

2. The method of claim 1, wherein the polishing process comprises a chemical mechanical polishing (CMP) process.

3. The method of claim 1, wherein the substrate comprises a silicon wafer.

4. The method of claim 1, wherein step (b) further comprises the steps of:

forming a first photoresist by coating the substantially entire surface of the substrate with the negative photoresist;

exposing the first photoresist using a first photo mask having an ink flow path pattern thereon; and forming the flow path forming layer by developing the first photoresist to remove an unexposed portion.

5. The method of claim 1, wherein the sacrificial layer comprises a positive photoresist or a non-photosensitive polymer precursor resin.

6. The method of claim 5, wherein the positive photoresist comprises an imide-based positive photoresist.

7. The method of claim 5, wherein the polymer precursor resin is at least one selected from a group consisting of a phenol resin, a polyurethane resin, an epoxy resin, a polyimide resin, an acryl resin, a poly-amid resin, a urea resin, a melamine resin, and a silicon resin.

8. The method of claim 1, wherein step (c) further comprises the step of forming the sacrificial layer to be higher than the flow path forming layer.

9. The method of claim 1, wherein step (c) further comprises the step of forming the sacrificial layer using a spin coating method.

10. The method of claim 1, wherein step (d) further comprises the step of:

flattening the upper surfaces of the flow path forming layer and the sacrificial layer by polishing the upper portions of the flow path forming layer and the sacrificial layer using a chemical mechanical polishing process until the height of the layers reaches a desired ink flow path height.

11. The method of claim 1, wherein step (e) further comprises the steps of:

forming a second photoresist by coating a negative photoresist on the flow path forming layer and the sacrificial layer;

exposing the second photoresist using a second photo mask having a nozzle pattern thereon; and forming a nozzle and a nozzle layer by developing the second photoresist to remove an unexposed portion.

12. The method of claim 1, wherein step (f) further comprises the steps of:

coating a photoresist on a back surface of the substrate;

forming an etching mask for forming the ink feed hole by patterning the photoresist; and etching the back surface of the substrate and exposing the back surface through the etching mask to form the ink feed hole.

13. The method of claim 12, wherein the back surface of the substrate is etched using a dry etching method using a plasma.

14. The method of claim 12, wherein the back surface of the substrate is etched using a liquid etching method using a tetramethyl ammonium hydroxide or a KOH as an etchant.

* * * * *